US006624358B2

(12) United States Patent
Krabec et al.

(10) Patent No.: US 6,624,358 B2
(45) Date of Patent: Sep. 23, 2003

(54) MINIATURE RF COAXIAL CABLE WITH CORRUGATED OUTER CONDUCTOR

(75) Inventors: James Krabec, Oak Lawn, IL (US); Jack Knowles, Kissimmee, FL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/023,312

(22) Filed: Dec. 13, 2001

(65) Prior Publication Data

US 2003/0111252 A1 Jun. 19, 2003

(51) Int. Cl.[7] ..... H01B 11/18
(52) U.S. Cl. ..... 174/102 D; 174/106 D
(58) Field of Search ..... 174/28, 102 D, 174/102 R, 110 F, 106 D; 333/12, 243

(56) References Cited

U.S. PATENT DOCUMENTS

| | | | | | |
|---|---|---|---|---|---|
| 3,323,083 | A | | 5/1967 | Ziegler, Jr. | 333/97 |
| 3,582,536 | A | * | 6/1971 | Miller | 138/121 |
| 3,691,488 | A | | 9/1972 | Holtum, Jr. | 333/84 R |
| 3,781,725 | A | | 12/1973 | Yoshida et al. | 333/84 R |
| 3,909,757 | A | | 9/1975 | Miyamoto et al. | 333/97 R |
| 3,963,999 | A | | 6/1976 | Nakajima et al. | 333/84 L |
| 4,151,365 | A | * | 4/1979 | Hacker | 156/54 |
| 4,280,225 | A | | 7/1981 | Willis | 455/55 |
| 4,339,733 | A | | 7/1982 | Smith | 333/237 |
| 4,368,350 | A | * | 1/1983 | Perelman | 174/102 D |
| 4,510,468 | A | * | 4/1985 | Mayer | 174/36 |
| 4,599,121 | A | | 7/1986 | Edwards et al. | 156/48 |
| 4,625,187 | A | | 11/1986 | Bocher | 333/237 |
| 4,660,007 | A | | 4/1987 | Edwards et al. | 333/237 |
| 4,718,854 | A | | 1/1988 | Capp et al. | 439/63 |
| 4,800,351 | A | | 1/1989 | Rampalli et al. | 333/237 |
| 4,964,805 | A | | 10/1990 | Gabany | 439/63 |
| 5,181,316 | A | * | 1/1993 | Pote et al. | 156/54 |
| 5,760,334 | A | * | 6/1998 | Ziemek | 174/102 D |

FOREIGN PATENT DOCUMENTS

| | | | |
|---|---|---|---|
| EP | 0 327 308 B1 | 9/1993 | H01R/43/20 |
| EP | 0 327 204 B1 | 7/1994 | H01R/13/621 |

* cited by examiner

*Primary Examiner*—Chau N. Nguyen
(74) *Attorney, Agent, or Firm*—Jenkens & Gilchrist

(57) ABSTRACT

A miniature coaxial cable having an outside diameter of less than 0.25 inch (6.3 mm). An inner conductor is surrounded by a foamed polymer dielectric and a continuous corrugated metal outer conductor surrounds the foamed dielectric. The cable of the invention has electrical performance superior to that of prior art cables having braided outer conductors and flexibility superior to that of cables having smooth tubular outer conductors.

14 Claims, 1 Drawing Sheet

MINIATURE RF COAXIAL CABLE WITH CORRUGATED OUTER CONDUCTOR

BACKGROUND OF THE INVENTION

This invention relates to coaxial cables such as are used for carrying high frequency electromagnetic signals, including radio, television, and microwave communications. More particularly, the invention relates to small diameter coaxial cables having improved flexibility and electrical performance relative to conventional coaxial cables.

Coaxial cables are generally of two types. Each has an inner conductor, surrounded by an outer (i.e., coaxial) conductor, with the space between the inner conductor and the outer conductor being filled with air, or a dielectric material, either a solid dielectric, or a foam dielectric. While the cables filled with air are the most effective in preventing signal loss, the space left between the inner conductor and outer conductor must be kept dry in order to avoid loss of electrical performance caused by intrusion of moisture. This often requires that the annular space be pressurized with dry air, which requires additional expensive facilities to provide dry air on a continuous basis. Cables which use a solid polymer dielectric are less expensive, but they are less efficient since air is a superior dielectric. Foam dielectrics have been widely used for many years. They provide good performance at lower cost than cables, which require that dry air be supplied to the annular space, and they are more efficient than cables, which employ solid dielectrics. It is not necessary to monitor the space between the inner conductor and the outer conductor, although moisture intrusion may be a problem if there should be a leak in the outer covering or the outer conductor.

The assignee of the present invention has obtained patents which discuss the advantages of foam dielectric filled coaxial cables and the methods by which they are made. Such coaxial cables typically have corrugated outer conductors which provide flexibility to the cables and which also resist the forces caused by differential thermal expansion between the inner conductor and outer conductor. The outer conductor is particularly subject to atmospheric conditions and may expand or contract depending on the air temperature and solar radiation. The inner conductor is subject to heating depending on the electromagnetic energy passing through it. These patents include U.S. Pat. No. 3,173,990 in which Lamons discusses the advantages of corrugating the outer conductor so that the foam dielectric is compressed at the root of the corrugations so that, in effect, each undulation compensates for differential thermal expansion independently of the others. Moisture intrusion is inhibited by the application of a viscous sealant in U.S. Pat. No. 3,394,400. Improved bending life of such cables is shown in U.S. Pat. No. 3,582,536 to be obtainable by using specific dimensions of the corrugations and metal thickness. An apparatus for carrying out annular corrugation of the outer conductor in a continuous process is disclosed in U.S. Pat. No. 3,780,556. Application of a foamed fluorocarbon resin to a corrugated coaxial cable is described in U.S. Pat. No. 4,304,713.

Coaxial cables which employ foam dielectrics between the inner conductor, typically a solid wire, and the corrugated outer conductor, usually a thin walled tube which has been corrugated after being wrapped around the dielectric foam, are widely and successfully used. Heretofore, such cables have been limited to external diameters larger than about 0.25 inch (6.35 mm). For smaller diameters, braided metal outer conductors have been used, to which hot molten tin is applied to provide a continuous metal surface for the outer conductor. These cables are not as efficient as cables with continuous tubes as outer conductors. Since typical polyethylene foam dielectric materials will not withstand the temperatures required for applying molten tin, it is necessary to use fluorocarbon dielectric materials which can withstand the temperatures required. Such materials are expensive and the cables have been found to lose efficiency resulting from leakage of the electromagnetic energy passing through the cable at frequencies greater than 1 GHz.

Alternatively, smooth wall outer cables have been used. These cables provide better electrical characteristics over the tinned braid cables. Smooth wall outer cables, however, are greatly affected by forces from differential thermal expansion in the inner and outer conductors. Also, smooth wall outer conductors can be easily crushed when in use. A 0.006 inch thick smooth copper tube having an outer diameter of 0.140 inch could be compressed by 0.030 inch by applying just over 20 lbs/in.

Therefore, it is an object of this invention to provide a small diameter (less than 0.25 inch) corrugated coaxial cable that includes a foam dielectric with an ability to resist the forces caused by differential thermal expansion between the inner and outer conductors.

It is a further object of the invention to provide a small diameter (less than 0.25 inch) corrugated coaxial cable that provides the shielding properties of a smooth wall cable.

BRIEF DESCRIPTION OF THE DRAWINGS

The foregoing and other advantages of the invention will become apparent upon reading the following detailed description and upon reference to the drawings.

Figure 1:
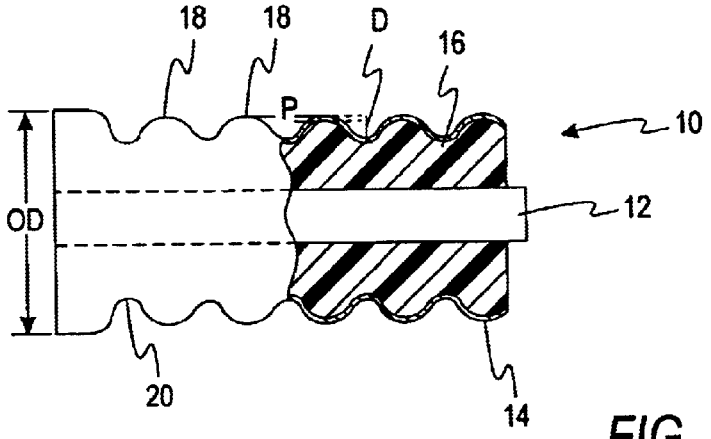
FIG. 1 is a side view of a miniature coaxial cable of the invention.
Figure 2:
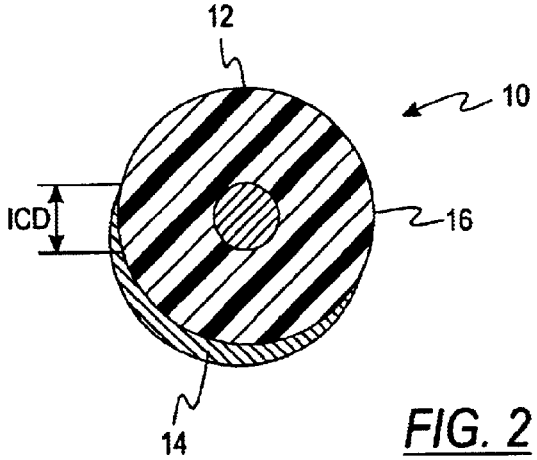
FIG. 2 is a cross-sectional view of the miniature coaxial cable of FIG. 1.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF THE PREFERRED EMBODIMENTS

In one aspect, the invention is a miniature coaxial cable made of a continuous outer metal conductor, that is, not of braided metal wire, and having an outer diameter less than 0.25 inch (6.3 mm). The outer conductor is corrugated, either annularly or helically, in order to provide more flexibility than a non-corrugated tubular metal conductor, while providing improved shielding of the inner conductor. The outer diameter of a corrugated outer conductor is the largest diameter, typically measured from one peak to a corresponding opposite peak. The space between the inner and outer conductors preferably contains a foamed polyethylene dielectric.

Turning now to FIG. 1, a coaxial cable 10 according to one embodiment of the present invention will be described. The coaxial cable 10 of the present invention has an outer diameter OD of less than 0.25 inch. The coaxial cable 10 further includes an inner conductor 12, an outer conductor 14, and a dielectric 16 separating the inner conductor 12 from the outer conductor 14. The inner conductor 12 is typically a solid wire, having a diameter ICD in the range of about 0.030 inch to about 0.050 inch.

The outer conductor 14 is a continuous thin walled tube. The dielectric 16 is a foamed polymer dielectric such as polyethylene. In the embodiment that utilizes a foam dielectric, the foam dielectric is typically deposited as a melt containing blowing agents and nucleating agents on the inner conductor 12. The outer conductor 14 is generally formed on the cable 10 after the foam dielectric 16 has been deposited on the inner conductor 12. The outer conductor 14 is generally a continuous strip of metal that is wrapped around the foam dielectric and closed by welding to form a continuous tube. After closing the tube, the outer conductor 14 is corrugated, either helically or annularly, as illustrated in the above-mentioned patents.

Since the outer conductor 14 is corrugated, the outer conductor 14 has peaks 18 and valleys 20. The distance from one peak 18 to an adjacent peak 18 is the pitch P of the corrugations, and the vertical distance between the peak 18 and the adjacent valley 20 is the depth D of the corrugations. The thickness T of the outer conductor 14 is less than about 0.008 inch, preferably less than about 0.006 inch.

Typically, corrugated coaxial cables have the outer conductors mechanically corrugated to achieve a certain flexibility and electrical specification performance. One measurement that is used to predict the performance is the Outer Diameter Build Up Factor (ODBF). The formula for calculating the ODBF is as follow.

$$ODBF=[2(D+T)/OD]^* 100$$

Assuming constant pitch P and thickness T, the higher the percentage, the greater the flexibility of the cable 10. For coaxial cables having an outer diameter OD larger than 0.25 inch, the typical ratio is from about 12% to about 30%.

As the outer diameter OD decreases in size, the ODBF increases. As the percentage gets higher and the coaxial cable outer diameter OD decreases, the degree of difficulty to manufacture the cable increases significantly. Because of the small dimensions involved, there is a need for more precise tooling designs, setup, and measuring. At such small outer diameter sizes (i.e., below 0.25 inch), the ODBF should be less than 40% to provide adequate space for the inner conductor 12 and the dielectric 16. In some embodiments, the ODBF is decreased by using a thinner metal, to form the outer conductor 14. In these embodiments, the thickness T of the outer conductor 14 is generally less than 0.008 inch, preferably less than 0.006 inch. These thickness' allow the outer conductor 14 to maintain adequate corrugation depth for good flex performance.

Figure 3:
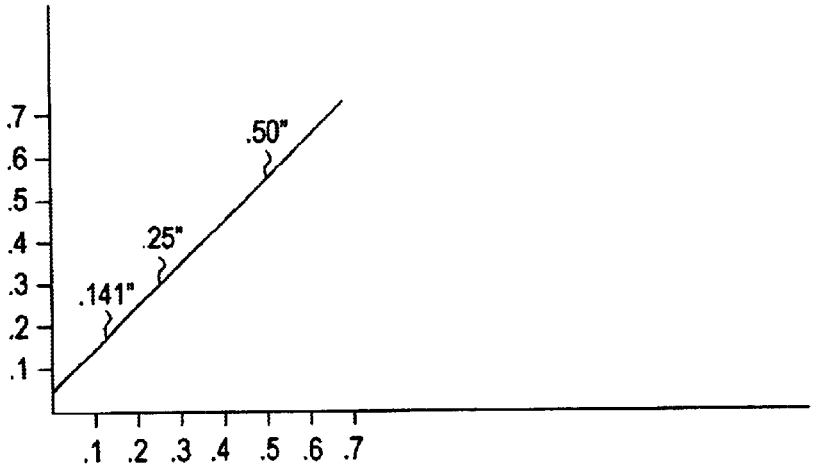
FIG. 3 is a graph charting the pitch to depth ratio versus the outer diameter of the coaxial cable.

To increase the flexibility of the coaxial cable 10, the pitch P may be varied. Traditionally, depth to pitch ratios range from a high value of 0.56 at a 0.50 inch diameter to 0.30 at a 0.25 inch diameter. As shown in FIG. 3, this creates a straight line having a slope of 1.04 and a y-intercept of 0.04. For the larger (i.e., 0.25 inch or greater) size diameters, these depth to pitch ratios provide good flexibility and operating characteristics. Following this logic, extrapolating on this graph from the prior art, a coaxial cable having an outer diameter OD of 0.141 would have an adequate depth to pitch ratio of 0.15. Cable built to this ratio, however, does not work, having been found that this value is inadequate in terms of flexibility. It has been discovered that for cables having an outer diameter less than 0.25 inch, a depth to pitch ratio of greater than about 0.20 is needed.

Preferably, the depth to pitch ratio should be greater than about 0.25. In coaxial cables having diameters less than 0.25 inch, depth to pitch ratios below 0.20 can cause the cable to kink if not formed and re-formed in a controlled manner, which is time consuming and costly. In one embodiment of the present invention, the pitch of the corrugations of the outer conductor is within the range of from about 0.070 inch to about 0.080 inch and the depth of the corrugations of the outer conductor is within the range of from about 0.015 inch to about 0.025 inch.

Thus, the preferred embodiments of the cable 10 of the present invention have an outer diameter of less than 0.25 inch, a depth to pitch ratio of greater than 0.25, and an outer conductor thickness of less than 0.008 inch. A 0.006 inch thick corrugated outer conductor 14 having an outer diameter OD of 0.140 inch needs a force of 50 lbs/in to compress the tube by 0.030 inch. This is a great improvement over the smooth wall designs noted above in the Background section. Also, the cable 10 is able to adequately resist the differential thermal expansion forces between the inner conductor 12 and the outer conductor 14, while still providing a shielding at higher frequencies, for example, above 1 GHz.

While the present invention has been described with reference to one or more particular embodiments, those skilled in the art will recognize that many changes may be made thereto, including alternate dielectric materials such as solid polymers, fluoropolymer foams, and skived polymer tapes, without departing from the spirit and scope of the present invention. Each of these embodiments and obvious variations thereof is contemplated as falling within the spirit and scope of the claimed invention, which is set forth in the following claims.

What is claimed is:

1. A miniature coaxial cable for carrying high frequency electromagnetic signals comprising:

an inner conductor;

a foamed polymer dielectric surrounding the inner conductor; and a corrugated continuous metal outer conductor surrounding the foamed polymer dielectric of the cable having an outer diameter less than about 0.25 inch and an Outer Diameter Build Up Factor ("OBDF") ratio of less than 40%.

2. The cable of claim 1, wherein said inner conductor has a diameter in the range of from about 0.030 inch to about 0.050 inch.

3. The cable of claim 1, wherein said foamed polymer dielectric is foamed polyethylene.

4. The cable of claim 1, wherein said outer conductor is annularly corrugated.

5. The cable of claim 1, wherein said outer conductor is helically corrugated.

6. The cable of claim 1, wherein the outer conductor has a thickness of less than about 0.008 inch.

7. The cable of claim 6, wherein the outer conductor has a thickness of less than about 0.006 inch.

8. The cable of claim 1, wherein the outer conductor is copper.

9. The cable of claim 1, wherein the outer conductor includes a depth to pitch ratio of greater than about 0.20.

10. The cable of claim 9, wherein the depth to pitch ratio is greater than about 0.25.

11. The cable of claim 1, wherein the outer conductor includes a depth of about 0.020 inch.

12. The cable of claim 1, wherein the outer conductor includes a pitch of about 0.080 inch.

13. The cable of claim 1, wherein the outer conductor includes a pitch of about 0.075 inch.

14. A miniature coaxial cable for carrying high frequency electromagnetic signals comprising:

an inner conductor;

a polymer dielectric surrounding the inner conductor; and a corrugated continuous metal outer conductor surrounding the polymer dielectric, the outer conductor having a thickness of less than 0.008 inch and an Outer Diameter Build Up Factor of less than 40%.

* * * * *